US007314197B2

(12) United States Patent
Tonohara et al.

(10) Patent No.: US 7,314,197 B2
(45) Date of Patent: Jan. 1, 2008

(54) WEB SEPARATING DEVICE

(75) Inventors: Kouji Tonohara, Kanagawa (JP); Kenichi Taninokuchi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 10/942,971

(22) Filed: Sep. 17, 2004

(65) Prior Publication Data

US 2005/0060856 A1 Mar. 24, 2005

(30) Foreign Application Priority Data

Sep. 19, 2003 (JP) ..... 2003-328954

(51) Int. Cl.
*B65H 21/00* (2006.01)

(52) U.S. Cl. ..... 242/555

(58) Field of Classification Search ..... 242/533.4, 242/533.5, 533.7, 533.8, 527.2, 527.3, 532.2, 242/554.2, 554.6, 555, 555.3, 555.4, 555.5, 242/555.6

See application file for complete search history.

(56) References Cited

U.S. PATENT DOCUMENTS 3,654,035 A * 4/1972 Takimoto ..... 156/505
4,171,780 A * 10/1979 Bugnone ..... 242/524.1
4,234,365 A * 11/1980 Shimizu et al. ..... 156/64
4,529,141 A * 7/1985 McClenathan ..... 242/527.1
5,954,292 A * 9/1999 Nawano et al. ..... 242/554.4

FOREIGN PATENT DOCUMENTS

JP 1-178957 A 7/1989
JP 01178957 A * 7/1989

* cited by examiner

*Primary Examiner*—Peter M. Cuomo
*Assistant Examiner*—William E. Dondero
(74) *Attorney, Agent, or Firm*—Sughrue Mion, PLLC

(57) ABSTRACT

A web separating device includes a cutting/joining drum, which is rotatable in contact with web of optical film on a peripheral surface thereof. A cutting drum is positioned for contacting the cutting/joining drum peripherally, and has a cutter for cutting the web being supplied in a width direction in cooperation with the cutting/joining drum, to obtain upstream and downstream web sections. A joining drum is positioned for contacting the cutting/joining drum peripherally, and attaches a guide leader to a front end of the upstream web section. Guide rollers are disposed for allowing passage of the web and the upstream and downstream web sections in a non-contact manner before and after being cut or attached.

17 Claims, 17 Drawing Sheets

WEB SEPARATING DEVICE

BACKGROUND OF THE INVENTION

1. Field of the Invention

The present invention relates to a web separating device. More particularly, the present invention relates to a web separating device for cutting web into two web sections, and capable of the cutting separating operation reliably and with a simplified structure.

2. Description Related to the Prior Art

Film of polymer is produced by solution casting or film casting. A term of web is used as a product of film casting, in particular when the film is film web of optical film. A producing line of the web is constituted by apparatuses and elements grouped in four sections, which are for film casting, film orienting, drying, and winding.

If the processes of the component apparatus are connected with continuity, occurrence of an error or failure in the middle of the producing line must cause a stop of the entirety of the producing line. This makes it unable to manage an amount of supply of dope as liquid material of polymer. Restarting the normal operation of the producing line requires considerably long time and high cost. In consideration of coping such a problem, a web separating device for web cutting is known, in which web is cut while transported continuously, to form an upstream web section and a downstream web section. The upstream web section is wound by a winder. The use of the web separating device enables an upstream positioned apparatus to continue operation even when a problem occurs in a downstream positioned apparatus. When the problem is solved, the upstream and downstream web sections are joined with one another, to set the producing line in the continuous state.

Furthermore, the web separating device is generally used for changing over from a process continuous state of continuity of the respective processes in the producing line to a process disconnected state in which the various processes are separate from one another. After the cutting into the upstream and downstream web sections, the upstream web section is wound by a winder. The downstream web section is provided with an advancing guide leader attached to a rear end thereof, and transported to the downstream positioned apparatus. There is a web roll or leader roll previously loaded in an advancing device. The advancing guide leader in a long form is advanced from the web roll to the downstream positioned apparatus. Furthermore, it is possible to use the web separating device in changing over from the process disconnected state to the process continuous state. At this time, the web separating device is used for joining the upstream and downstream web sections extending through respectively the upstream and downstream positioned apparatuses, so the process continuous state is set again for the producing line. Accordingly, the web separating device of the known type has performance for separation and joining.

JP-A 1-178957 discloses a known type of the web separating device. The web separating device includes a joining drum, a cutter roller, and first and second joining rollers. The joining drum includes a suction mechanism and a guide roller. The first joining roller is supported on a shiftable arm. The joining drum and the cutter roller cooperate together to cut the web. The upstream web section obtained from the web is attached to the advancing guide leader which is retained on the first joining roller.

However, the web separating device according to JP-A 1-178957 has shortcomings in that the first joining roller is shifted to a predetermined position in synchronism with the joining drum, and also must be rotated upon discontinuing the suction of the advancing guide leader. Difficulties in the operation are extremely high because even a complicated combination of movement requires high precision in successive steps.

It is likely that the advancing guide leader adheres incidentally to the downstream web section should the shift of the first joining roller be too early, or should rotation of the first joining roller start too early. A further problem lies in an error in the positioning of the front end of the upstream web section outside the web path in the web transport after the joining, should the shift of the first joining roller be too late, or should rotation of the first joining roller start too late. Due to various errors, the web is likely to be broken accidentally. To solve such problems, use of a certain motor with high performance or a suction mechanism with quick response may be conceived. However, a control system associated with such elements for joining operation inevitably require a high cost of manufacture, and not consistent with a low manufacturing cost.

SUMMARY OF THE INVENTION

In view of the foregoing problems, an object of the present invention is to provide a web separating device for cutting web into two web sections, and capable of the cutting separating operation reliably and with a simplified structure.

In order to achieve the above and other objects and advantages of this invention, a web separating device for separating a continuously transported web into upstream and downstream web sections, wherein a guide leader is connected therewith after separation, is provided. A cutting drum is disposed on a first side with respect to a web path of the web, and has a cutter for cutting the web in a width direction thereof. A cutting/joining drum is disposed on a second side with respect to the web path, for contacting the cutting drum with a peripheral surface thereof at a time of cutting. A first joining drum is disposed on the first side with respect to the web path and downstream from the cutting drum, has the guide leader retained thereon, for contacting the cutting/joining drum with a peripheral surface thereof, and for attaching a rear end of the guide leader to a front end of the upstream web section after cutting with the cutting drum. A path forming unit is disposed between the cutting drum and the cutting/joining drum, and between the cutting/joining drum and the first joining drum, for passage of the web in a non-contact manner from the cutting drum, the cutting/joining drum, and the first joining drum. A rotation control unit rotates the cutting drum, the cutting/joining drum, and the first joining drum in synchronism.

Furthermore, a second joining drum is disposed downstream from the first joining drum, positioned on the first side with respect to the web path, for contacting the cutting/joining drum with a peripheral surface thereof, and for attaching a guide leader to a rear end of the downstream web section. A second path forming unit is disposed between the cutting/joining drum and the second joining drum, for passage of the web in a non-contact manner. The rotation control unit further keeps the second joining drum and the cutting/joining drum in synchronism.

At least one of the cutting/joining drum and the first joining drum further comprises a drum core having a first portion for constituting a drum peripheral surface partially, and a second portion having a smaller diameter than the drum peripheral surface. The path forming unit includes a rotatable guide roller for guiding the web outside the second portion of the drum core.

The at least one of the cutting/joining drum and the first joining drum further comprises first and second end disks having edges for constituting the drum peripheral surface. The drum core extends and is supported between the first and second end disks, and the guide roller extends between the first and second end disks, and is secured thereto in a rotatable manner.

The cutter protrudes from a peripheral surface of the cutting drum. The cutting/joining drum includes a receiving slot, formed in a peripheral surface thereof, for receiving entry of the cutter.

The cutting/joining drum includes a suction unit for suction of the front end of the upstream web section close to an upstream edge of the receiving slot upstream with respect to a drum rotational direction.

In one preferred embodiment, the cutting/joining drum includes a suction unit for suction of the rear end of the downstream web section close to a downstream edge of the receiving slot downstream with respect to a drum rotational direction.

The cutting drum includes a biasing mechanism for biasing the front end of the upstream web section close to the cutter and upstream from the cutter according to a drum rotational direction.

The biasing mechanism comprises a resilient member or an air blowing mechanism.

The front end of the upstream web section upon being cut is directed within an angular range of ±10 degrees with reference to a vertically downward direction.

According to one aspect of the invention, a web separating device for separation of web transported continuously includes a cutting/joining drum, rotatable in contact with the web on a peripheral surface thereof. A cutting drum is positioned opposite to the cutting/joining drum with respect to a web path of the web, for contacting the cutting/joining drum with a peripheral surface thereof, the cutting drum having a cutter for cutting the web in a width direction thereof in cooperation with the cutting/joining drum, to obtain upstream and downstream web sections. A joining drum is positioned opposite to the cutting/joining drum with respect to the web path, for contacting the cutting/joining drum with a peripheral surface thereof, and for attaching a guide leader to a rear end of the downstream web section. A rotation control unit rotates the cutting/joining drum, the cutting drum, and the joining drum. A path forming unit is disposed between the cutting/joining drum and the cutting drum, and between the cutting/joining drum and the joining drum, for allowing passage of the web and the upstream and downstream web sections in a non-contact manner before and after being cut or attached.

According to another aspect of the invention, a web separating device for separation of web transported continuously includes a cutting/joining drum, rotatable in contact with the web on a peripheral surface thereof. A cutting drum is positioned opposite to the cutting/joining drum with respect to a web path of the web, for contacting the cutting/joining drum with a peripheral surface thereof, the cutting drum having a cutter for cutting the web in a width direction thereof in cooperation with the cutting/joining drum, to obtain upstream and downstream web sections. A spindle is positioned opposite to the cutting/joining drum with respect to the web path, for contacting the cutting/joining drum with a peripheral surface thereof, and for winding the upstream web section. A rotation control unit rotates the cutting/joining drum, the cutting drum, and the spindle. A path forming unit is disposed between the cutting/joining drum and the cutting drum, and between the cutting/joining drum and the spindle, for allowing passage of the web and the upstream and downstream web sections in a non-contact manner before and after being cut. A moving mechanism moves the spindle between a takeup position and a web winding position, wherein the spindle, when in the takeup position, contacts the cutting/joining drum, for a front end takeup of the upstream web section, and when in the web winding position, moves away from the cutting/joining drum, and winds the upstream web section.

Furthermore, a joining drum is disposed downstream from the spindle, positioned opposite to the cutting/joining drum according to the web path of the web, for contacting the cutting/joining drum with a peripheral surface thereof, to attach a guide leader to a rear end of the downstream web section.

Furthermore, a spindle holder arm supports the spindle in a rotatable manner. The moving mechanism includes an arm shifting mechanism for shifting the spindle holder arm in one direction, to move the spindle to respectively the takeup position and the web winding position. An arm rotating mechanism rotates the spindle holder arm when the spindle is in the web winding position, to move the spindle further to an exchanging position adapted to exchange of the spindle.

According to still another aspect of the invention, a web separating device for separation of web transported continuously includes a cutting drum having a cutter for cutting the web in a width direction thereof, to obtain upstream and downstream web sections. A spindle is positioned opposite to the cutting drum with respect to a web path of the web, for contacting the cutting drum with a peripheral surface thereof, for winding the upstream web section. A rotation control unit rotates the cutting drum and the spindle. A path forming unit is disposed between the cutting drum and the spindle, for allowing passage of the web and the upstream and downstream web sections in a non-contact manner before and after being cut. A moving mechanism moves the spindle between a takeup position and a web winding position, wherein the spindle, when in the takeup position, contacts the cutting drum, for cutting of the web with the cutter and for a front end takeup of the upstream web section, and when in the web winding position, moves away from the cutting drum, to wind the upstream web section.

The moving mechanism moves the spindle further to a joining position which is downstream from the takeup position according to the web path, and where a peripheral surface of the spindle contact a peripheral surface of the cutting drum. Furthermore, a joining drum is disposed downstream from the cutting drum according to the web path, for retaining a rear end of a guide leader and for contact the spindle in the joining position with a peripheral surface thereof, and for attaching a front end of the upstream web section to the guide leader after cutting of the web with the cutting drum.

Furthermore, a spindle holder arm supports the spindle in a rotatable manner. The moving mechanism includes an arm rotating mechanism for rotating the spindle holder arm, to move the spindle to respectively the takeup position and the web winding position.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1A:
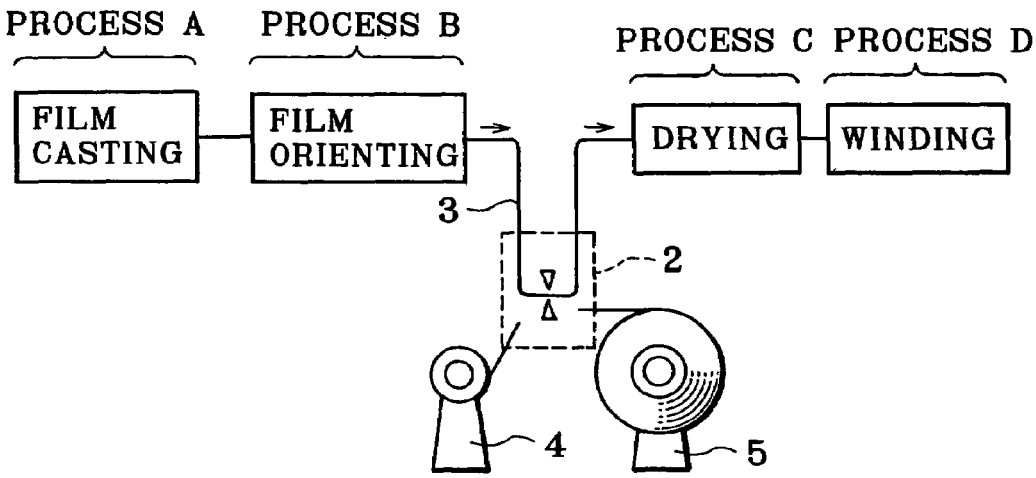
FIG. 1A is a block diagram schematically illustrating a state of a producing line before a separating sequence of a web separating device.
Figure 1B:
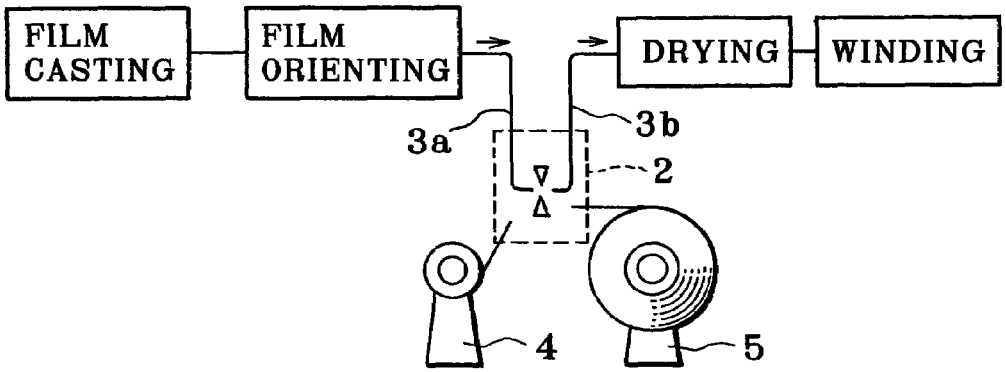
FIG. 1B is a block diagram schematically illustrating a state during the separating sequence.
Figure 1C:
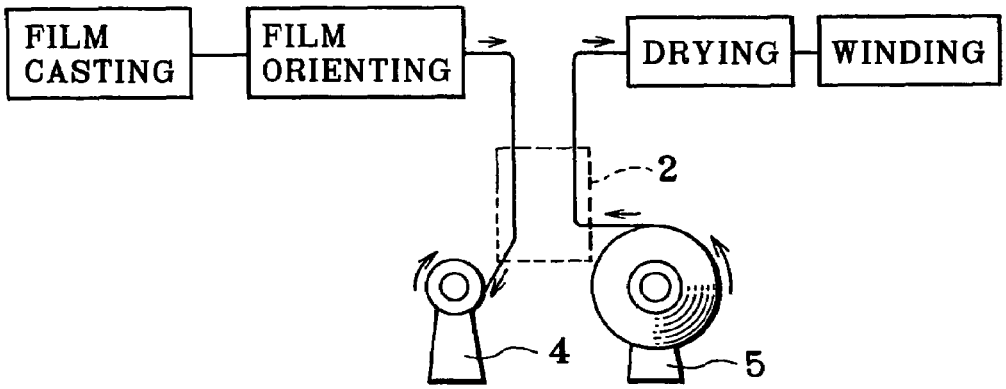
FIG. 1C is a block diagram schematically illustrating a state after the separating sequence.

In FIGS. 1A, 1B and 1C, a producing line of a web is illustrated. If the web is film web of optical film, the producing line is constituted by apparatuses and elements grouped in four sections, which are associated with a film casting process A, a film orienting process B, a drying process C, and a winding process D. A web separating device 2 provided according to the present invention is used between two adjacent apparatuses, for example the apparatus for the film orienting process B, such as a tentering machine, and the apparatus for the drying process C. It is to be noted that this grouping is not compulsory. It is possible to group the producing line into a greater number of partial apparatuses.

When the separating operation of the web separating device 2 is completed, a web 3 transported from an upstream side is cut into an upstream web section 3*a* and a downstream web section 3*b*. See FIG. 1B. A winding device 4 winds up the upstream web section 3*a*. The downstream web section 3*b* is further transported in a downstream direction. A guide leader is supplied by an advancing device 5, and connected to the downstream web section 3*b*, which is transported together with this. The web, having the initial state of FIG. 1A, comes to have the state of FIG. 1B, before the separated state of FIG. 1C.

When the web separating device 2 operates for connection, the upstream and downstream web sections 3*a* and 3*b* are interconnected for forming the web 3 again. The material having had the separate state of FIG. 1C comes to have the connected state of FIG. 1A. The construction of the web separating device 2 will be hereinafter described.

Figure 2A:
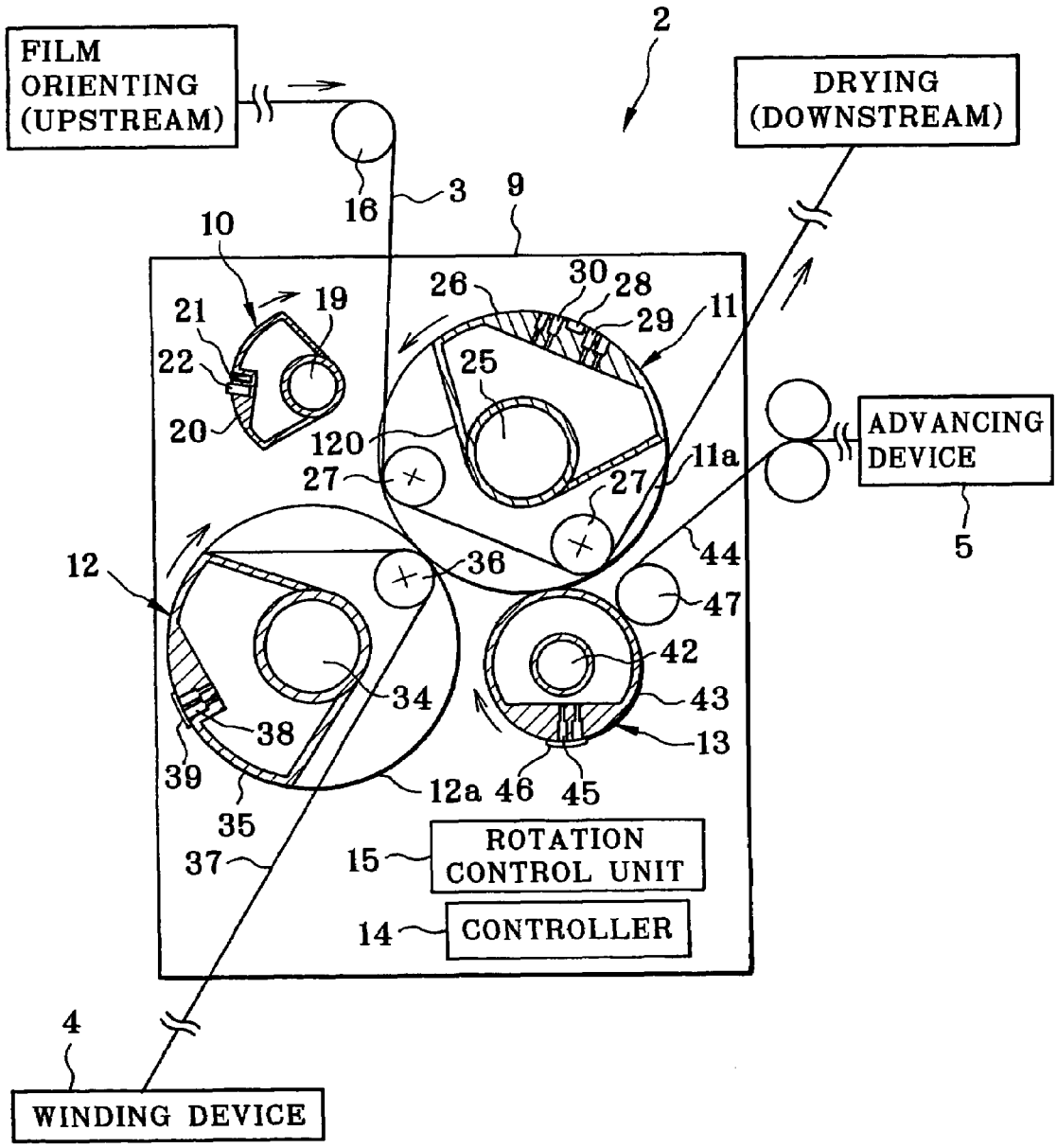
FIG. 2A is a front elevation with a block diagram, illustrating a web separating device.

In FIG. 2A, the web separating device 2 has a frame 9, and is constituted by a cutting drum 10, a cutting/joining drum 11, a first joining drum 12, a second joining drum 13, a controller 14 and a rotation control unit 15. The frame 9 contains and supports the various elements. The controller 14 and the rotation control unit 15 are incorporated in the frame 9.

The web separating device 2 is disposed between an upstream positioned apparatus for the film orienting process, and a downstream positioned apparatus for the drying process. A pass roll 16 guides the web 3 to the web separating device 2 during the transport from the upstream positioned apparatuses to the downstream positioned apparatuses.

The cutting drum 10 is rotatable about a shaft 19, and is disposed on one side with respect to the path of the web 3 being guided. One gap portion of the cutting drum 10 is cut out and shaped in a sector form. The gap portion causes the web 3 to pass in a non-contact manner from the cutting drum 10. A drum peripheral surface 20 of the cutting drum 10 is provided with a cutter 21, which protrudes, and cuts the web 3 in a web width direction. A blade of the cutter 21 extends in parallel with the shaft 19 in the drum peripheral surface 20. A biasing sponge rubber 22 as a biasing mechanism is an elastic material, is disposed upstream from the cutter 21 according to a drum rotational direction, and is protruded over a cutting edge of the cutter 21.

Figure 2B:
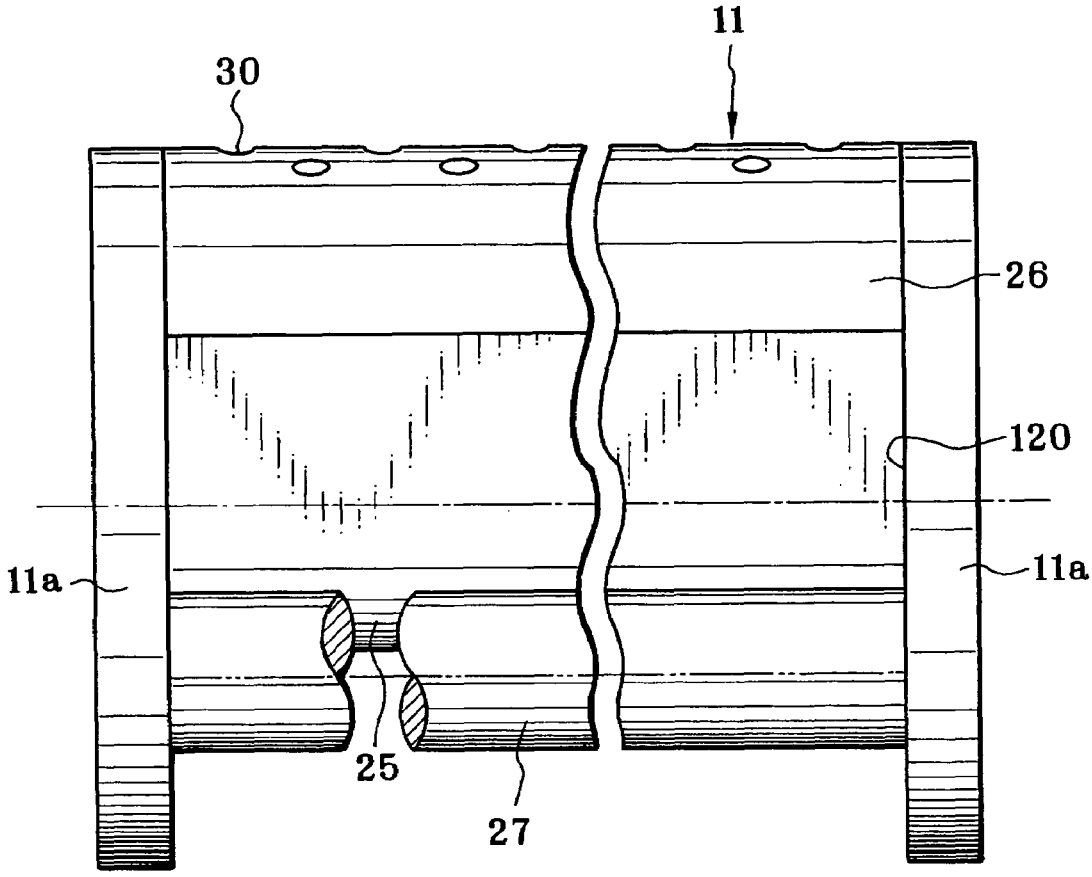
FIG. 2B is a front elevation, partially cutaway, illustrating a cutting/joining drum.

In FIGS. 2A and 2B, the cutting/joining drum 11 rotatable about a drum core 25 is disposed on a second side with respect to the path of the web 3. A drum peripheral surface 26 of the cutting/joining drum 11 comes to contact the drum peripheral surface 20 of the cutting drum 10 at the time of web cutting. There is one gap portion 120 in the periphery of the cutting/joining drum 11 in a sector shape as viewed in section. Two guide rollers 27 are secured to the cutting/joining drum 11 inside the gap portion 120, and enable the web 3 to pass in a non-contact manner from the cutting/joining drum 11 as a path forming guide. Two end disks or plates 11*a* of the cutting/joining drum 11 support the guide rollers 27 in a rotatable manner. When the cutting/joining drum 11 rotates, the guide rollers 27 also rotate about the drum core 25 of the cutting/joining drum 11.

A receiving slot 28 is formed in the drum peripheral surface 26 of the cutting/joining drum 11 for receiving the blade of the cutter 21. There are suction mechanisms 29 and 30 positioned upstream and downstream from the receiving slot 28 with respect to the rotational direction of the cutting/joining drum 11. Plural holes are formed in the drum peripheral surface 26, through which air is sucked by the suction mechanisms 29 and 30 to retain the web 3. Sequences of operation of the suction mechanisms 29 and 30 are controlled by the controller 14.

The first joining drum 12 is positioned downstream from the cutting drum 10, and on the same side with respect to the web path. The first joining drum 12 is rotatable about a drum core 34. A drum peripheral surface 35 of the first joining drum 12 comes to contact the drum peripheral surface 26 of the cutting/joining drum 11 at the time of joining. There is one gap portion in the periphery of the first joining drum 12 in a sector shape as viewed in section. A guide roller 36 is secured to the first joining drum 12 inside the gap portion, and enables the web 3 to pass in a non-contact manner from the first joining drum 12. End disks or plates 12*a* of the first joining drum 12 support the guide roller 36 in a rotatable manner. When the first joining drum 12 rotates, the guide roller 36 also rotates about the drum core 34 of the first joining drum 12. A suction mechanism 38 is structurally the same as the suction mechanisms 29 and 30. A winding guide leader 37 has a rear end 110 which the suction mechanism 38 retains by suction. A double-sided adhesive tape 39 is attached to the rear end 110 of the winding guide leader 37, for attachment of the web 3.

A shaft 42 for the second joining drum 13 is positioned downstream from the first joining drum 12 with respect to the path of the web 3. The second joining drum 13 is rotatable about the shaft 42. A drum peripheral surface 43 is disposed to contact the drum peripheral surface 26 of the cutting/joining drum 11. A suction mechanism 45 is disposed on the drum peripheral surface 43 of the second joining drum 13. A guide leader or guide sheet 44 has a front end 100 retained by suction of the suction mechanism 45. A transfer roller (not shown) is disposed in the vicinity of the second joining drum 13. A double-sided adhesive tape 46 is attached to the front end 100 of the guide leader 44 by the transfer roller. There is a cutting mechanism (not shown) between the second joining drum 13 and the advancing device 5 for cutting the web in the web width direction. A pass roll 47 is disposed near to the second joining drum 13 for contacting the drum peripheral surface 43, and nips and transports the web.

The rotation control unit 15 is responsive to command signals from the controller 14, and controls rotations of the cutting drum 10, the cutting/joining drum 11, and the first and second joining drums 12 and 13. An example of the rotation control unit 15 is constituted by a motor driver, a servo motor, and a motion transmitting mechanism, the servo motor including a rotary encoder. Upon command signals from the controller 14, the motor driver determines values of current and voltage to be output to the servo motor. When the servo motor is driven, its rotational force is transmitted to drum cores to rotate the drums. If it is intended that the drums should rotate particularly in synchronism with one another, it is desirable to use gear mechanisms for transmission in order to synchronize the drums mechanically. In the embodiment, the first joining drum 12 is synchronized with the cutting/joining drum 11 by means of a gear mechanism.

The operation of the above construction is described now. There are two modes of changeover of the producing line. A first of the two is to change over from a continuous state of various processes in the manufacture to a disconnected state between the processes. The second mode is the reverse direction, namely to change over from a disconnected state between the processes to a continuous state of the processes. At first, FIGS. 3A-6B are referred to for describing a separating operation of the web separating device 2. The separating process is for the first mode to change over from the state of FIG. 1A to the state of FIG. 1C.

Figure 3A:
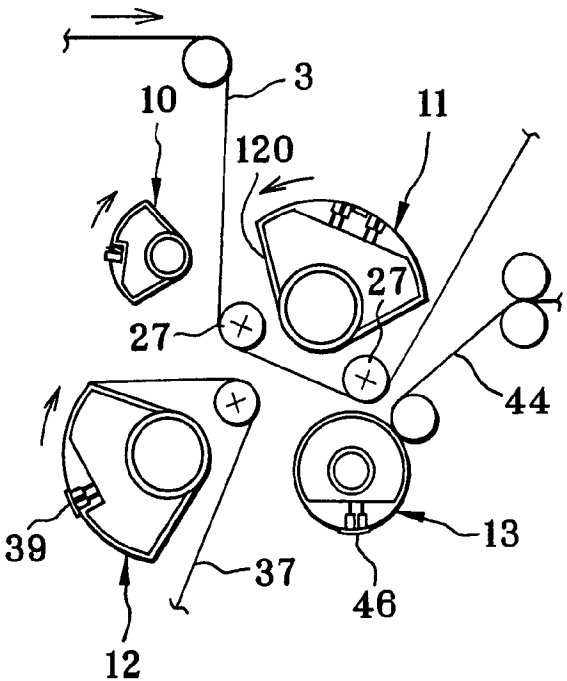
FIGS. 3A and 5A are explanatory views in elevation illustrating an initial state of the web separating device in a separating sequence.
Figure 5A:
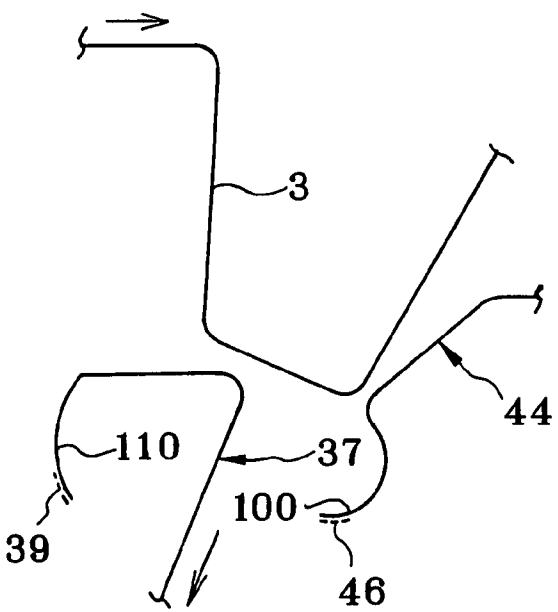

In FIGS. 3A and 5A, the web 3 fed from an upstream supply unit is guided between the cutting drum 10 and the cutting/joining drum 11, between the cutting/joining drum 11 and the first joining drum 12, and between the cutting/joining drum 11 and the second joining drum 13, and then fed in the downstream direction. If the processes are changed over in the disconnected state disconnected from one another, separation of the web 3 is required. Thus, the controller 14 outputs a separation actuating signal. Then a command signal is sent by the controller 14 to the rotation control unit 15, which causes the cutting drum 10, the cutting/joining drum 11 and the first joining drum 12 to rotate in the directions indicated by the arrows in FIG. 3A. The drums 10-12 are controlled for their peripheral rotational speeds to be equal to a transporting speed of the web 3. During this, the first joining drum 12 is synchronized with the cutting/joining drum 11 by a gear mechanism. At first, the web 3 is nipped by the cutting drum 10 and the cutting/joining drum 11, and transported in the nipped state.

Figure 3B:
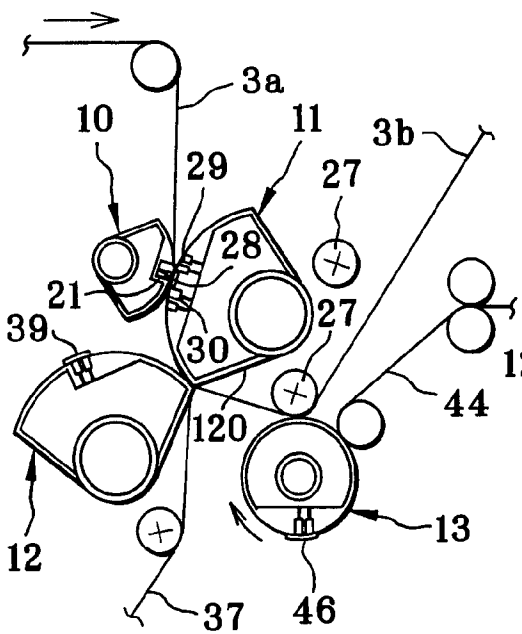
FIGS. 3B and 5B are explanatory views in elevation illustrating a state of cutting the web in the web separating device.
Figure 5B:
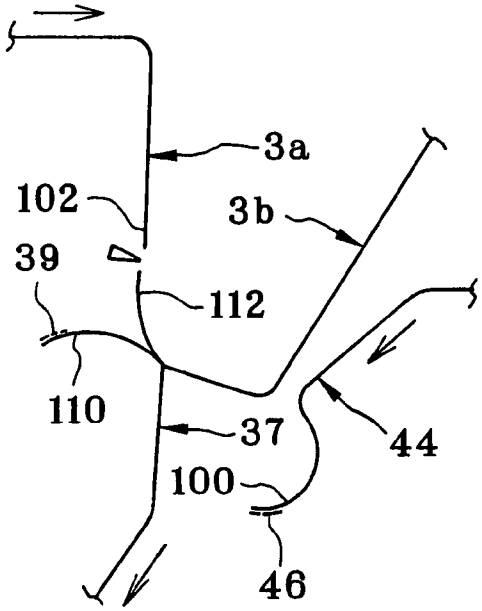

As illustrated in FIGS. 3B and 5B, the web 3 is squeezed by the cutter 21 and the receiving slot 28 while nipped between by the cutting drum 10 and the cutting/joining drum 11. The web 3 is cut into the upstream and downstream web sections 3*a* and 3*b*. At the time of cutting, the suction mechanisms 29 and 30 operate for suction and retention of a front end 102 of the upstream web section 3*a* and a rear end 112 of the downstream web section 3*b*. The front end 102 of the upstream web section 3*a* is biased by the biasing sponge rubber 22 toward the cutting/joining drum 11, and can be free from tightly contacting the cutter 21. Therefore, the upstream web section 3*a* can be retained on the cutting/joining drum 11 stably without being wound about the cutting drum 10. A direction of feeding of the front end 102 of the upstream web section 3*a* immediately after cutting is regulated within an angular range of ±10 degrees as viewed according to the downward vertical direction. The advancing direction of the web 3 can be equal to a force receiving direction of the front end of the upstream web section 3*a* under gravity. The front end 102 can be kept sufficiently stable. At the time of cutting, the downstream web section 3*b* has a portion nipped between the cutting/joining drum 11 and the first joining drum 12 in a position downstream from the cutting position. It is possible to keep the downstream web section 3*b* sufficiently stable even if force of the suction is insufficient due to delay in the operation of the suction mechanism 30.

Figure 3C:
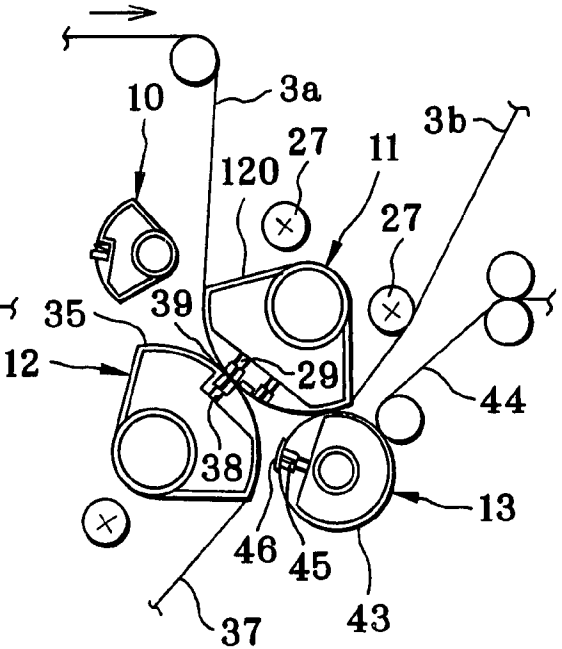
FIGS. 3C and 5C are explanatory views in elevation illustrating a state of attachment of a guide leader to an upstream web section in the web separating device.
Figure 4B:
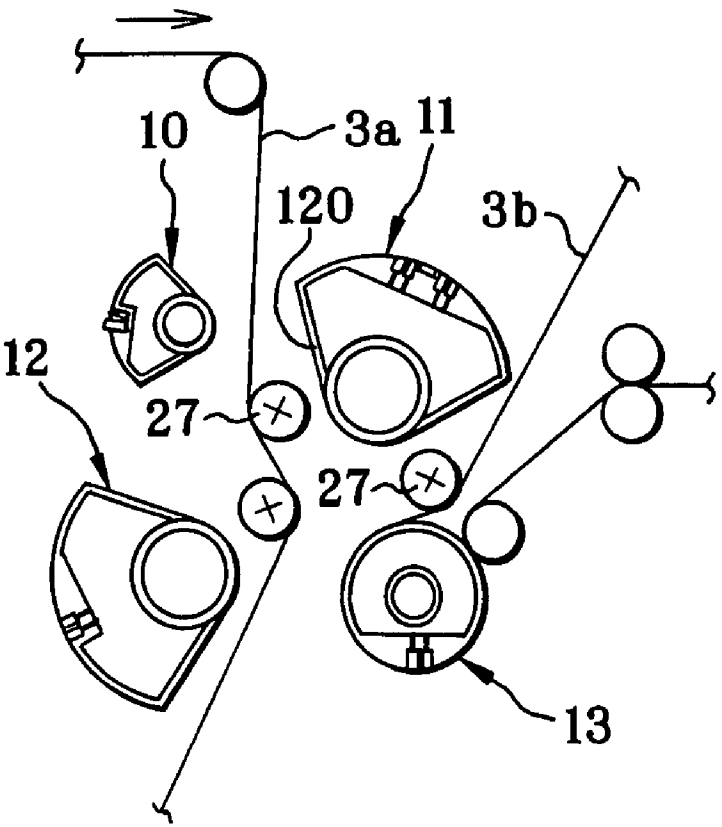
FIGS. 4B and 6B are explanatory views in elevation illustrating a finally separated state in the web separating device.
Figure 4A:
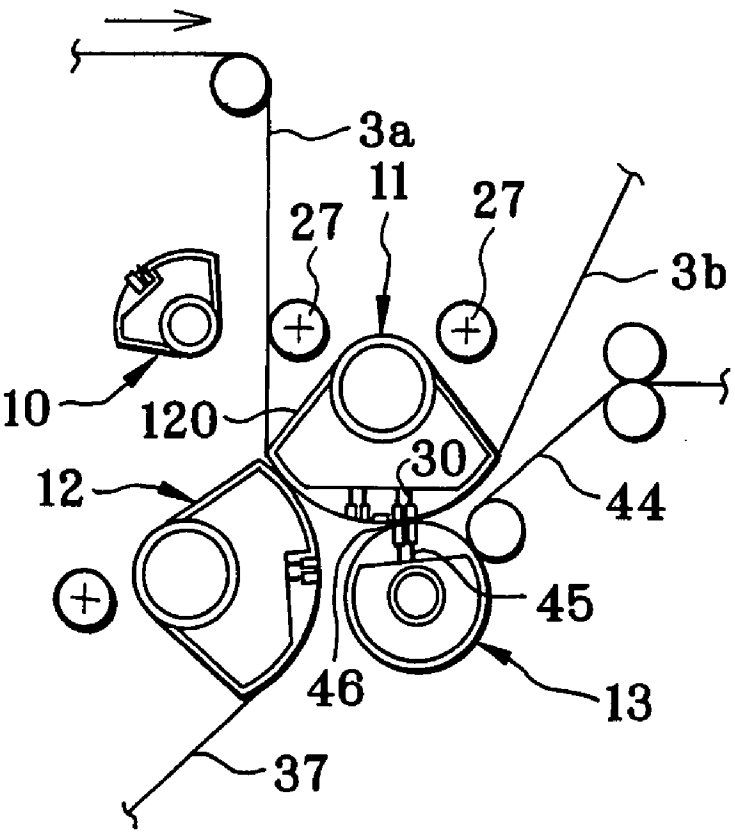
FIGS. 4A and 6A are explanatory views in elevation illustrating a state of attachment of a guide sheet to a downstream web section in the web separating device.
Figure 5C:
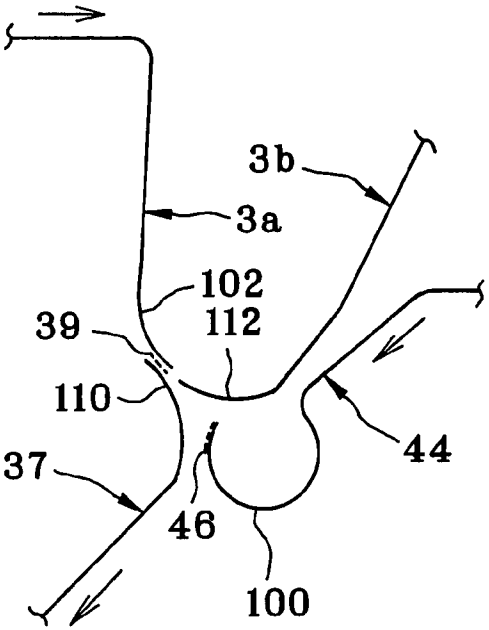

In FIGS. 3C and 5C, the front end 102 of the upstream web section 3*a* becomes nipped between the cutting/joining drum 11 and the first joining drum 12 in the course of rotations of the drums 10-13. The suction mechanism 38 is located in the drum peripheral surface 35 of the first joining drum 12, and is ready in suction of the winding guide leader 37 extending from the winding device 4. The double-sided adhesive tape 39 is attached to the rear end 110 of the winding guide leader 37. At the same time as the nipping, the double-sided adhesive tape 39 is attached to the front end 102 of the upstream web section 3*a*. Thus, the winding guide leader 37 is connected with the upstream web section 3*a*. After this, suction of the suction mechanism 29 is discontinued. The upstream web section 3*a* and the winding guide leader 37 are released from the suction of the drums. As illustrated in FIGS. 4A and 6A, the upstream web section 3*a* is nipped between the cutting/joining drum 11 and the first joining drum 12, and then wound by the winding device 4. See FIGS. 4B and 6B.

In FIGS. 3C and 5C, the downstream web section 3*b* is fed while nipped between the cutting/joining drum 11 and the second joining drum 13. The suction mechanism 45 is located on the drum peripheral surface 43 of the second joining drum 13, where the guide leader or guide sheet 44 is prepared in suction after advance from the advancing device 5. The front end 100 of the guide leader 44 has the double-sided adhesive tape 46 attached thereto. In FIGS. 4A and 6A, the front end 100 of the guide leader 44 is attached to the rear end 112 of the downstream web section 3*b* by the double-sided adhesive tape 46 at the same time as the nipping step. Accordingly, the guide leader 44 is connected with the downstream web section 3*b*. After the connection, the suction mechanisms 30 and 45 are controlled to discontinue the suction. The downstream web section 3*b* and the guide leader 44 are released from the suction of the drums. When the downstream web section 3*b* is fed, the web in the advancing device 5 is advanced by cooperation of the guide leader 44.

Figure 6B:
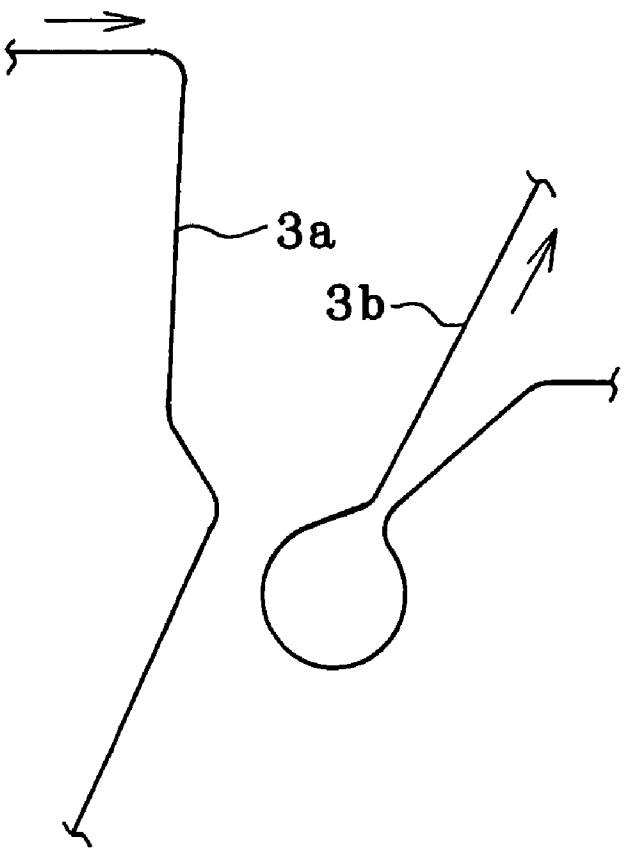
Figure 6A:
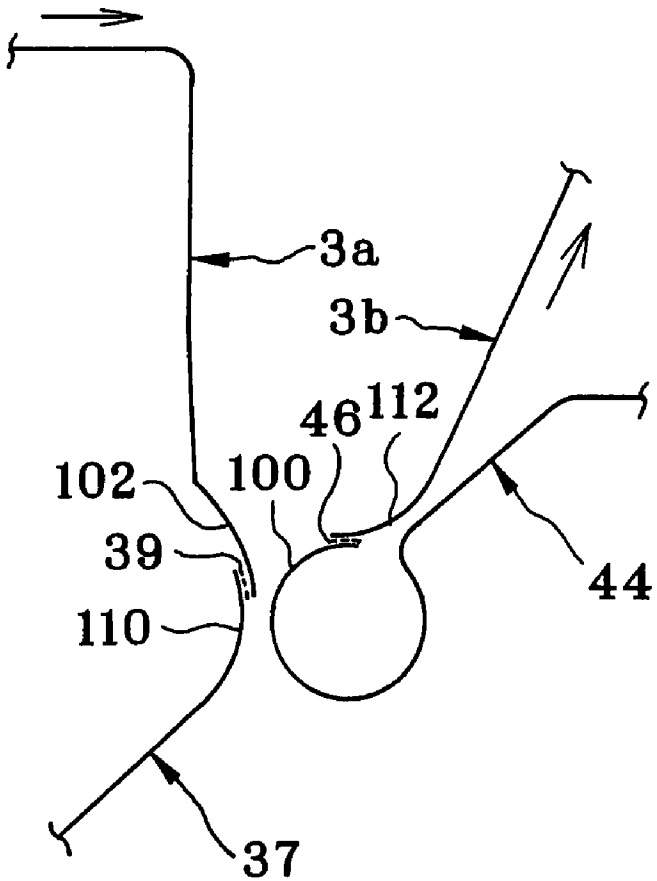

Upon completing plural processes in series in FIGS. 4B and 6B, the web 3 comes to have a separated state unlike the continuous state during the transport. The cutting drum 10, the cutting/joining drum 11 and the first joining drum 12 stop rotation. However, the second joining drum 13 continues rotation in order to transport the web.

In the above embodiment, the downstream web section 3*b* is fed together with the different web prepared at the advancing device 5. This is because the web separating device 2 is used for changing over from a continuous state of various processes in the manufacture to a disconnected state between the various processes. However, the use of the different web to be fed is unnecessary if the web separating device 2 is used upon occurrence of a difficulty in a downstream positioned apparatus. It is also unnecessary to connect the guide leader or guide sheet 44 to the downstream web section 3*b*. Furthermore, the web separating device 2 can be used upon occurrence of a difficulty in an upstream positioned apparatus. Winding of the upstream web section 3*a* can be unnecessary.

Now, FIGS. 7A-10B are referred to for describing the connecting process. The connecting process is used for a change from the state of FIG. 1B to the state of FIG. 1A. Note that a term of a first web 52 is used for referring to an upstream web. A term of a second web 53 is used for referring to a downstream web.

Figure 7A:
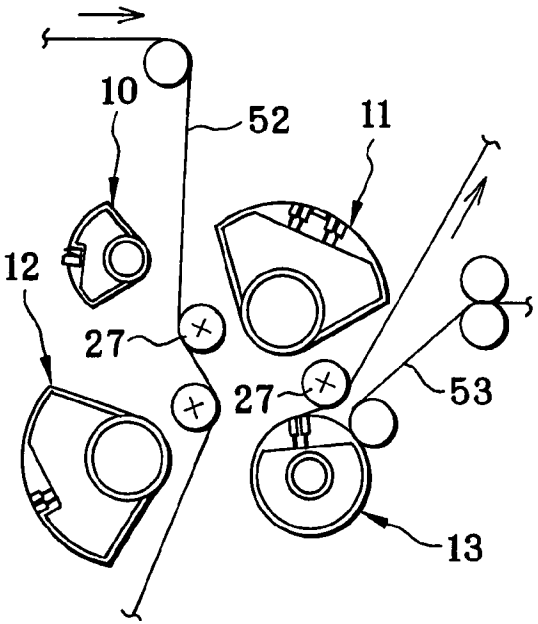
FIGS. 7A and 9A are explanatory views in elevation illustrating an initial state of the web separating device in a combining sequence.
Figure 9A:
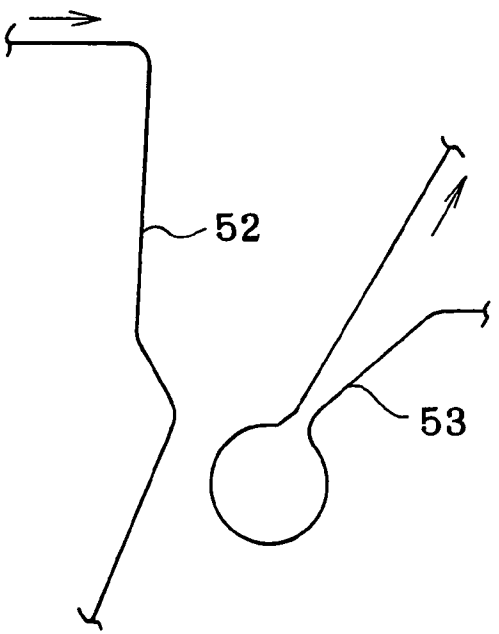

In FIGS. 7A and 9A, the upper and lower stations operate in a disconnected manner, respectively to feed the first and second webs 52 and 53. The cutting drum 10, the cutting/joining drum 11 and the first joining drum 12 are stopped rotationally. Only the second joining drum 13 rotates for web feeding.

Figure 7B:
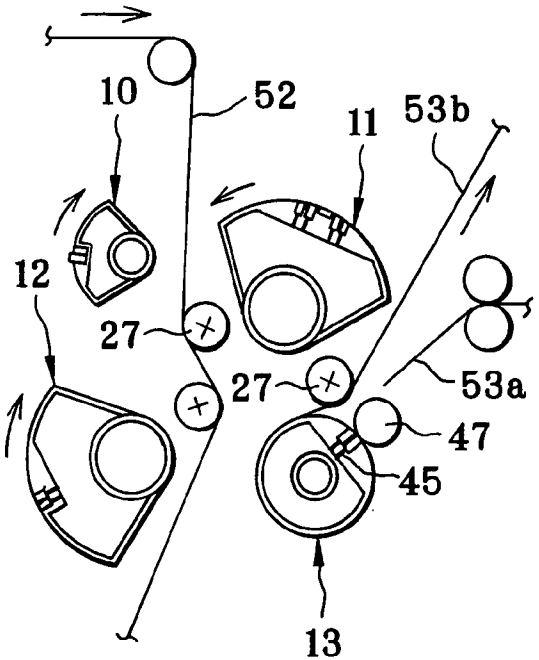
FIGS. 7B and 9B are explanatory views in elevation illustrating a state of preliminary cutting of a second web in the web separating device.
Figure 9B:
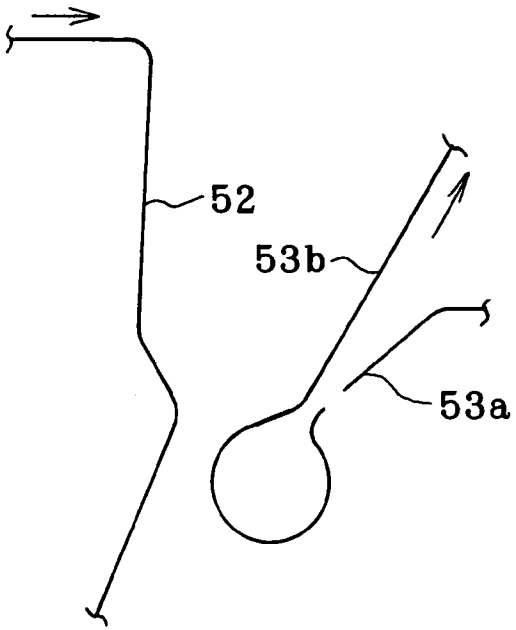

In the case of changing over to the continuous state of partial processes in the entirety, the controller 14 generates a connecting command signal of a web connecting operation. In FIGS. 7B and 9B, the second web 53 is cut by a cutting mechanism (not shown) when the second joining drum 13 becomes positioned at a predetermined rotational angle. Note that a rotational angle of the second joining drum 13 is determined by the controller 14 in response to a signal from a rotary encoder. The second web 53 is cut into a second upstream web section 53*a* and a second downstream web section 53*b*, which becomes nipped between the pass roll 47 and the second joining drum 13. At the same time, the suction mechanism 45 starts being driven, to retain the end of the second downstream web section 53*b* on the second joining drum 13 by suction. In the advancing device 5, the spindle rotates in the winding direction or backward direction, to wind the second upstream web section 53*a*. Also, the cutting drum 10, the cutting/joining drum 11 and the first joining drum 12 start rotation in a manner similar to the separating process.

Figure 7C:
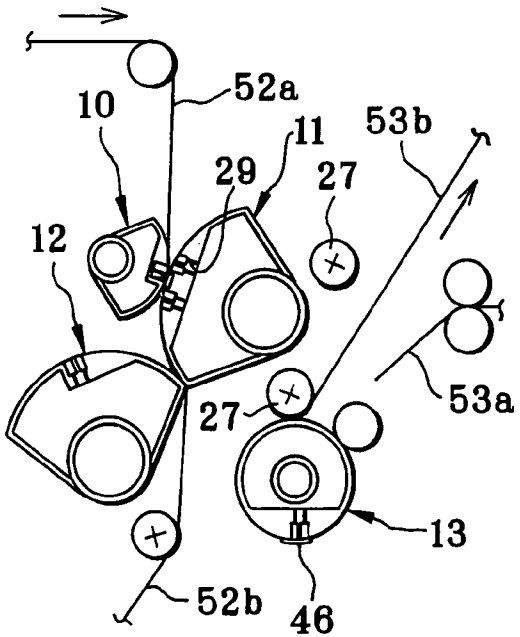
FIGS. 7C and 9C are explanatory views in elevation illustrating a state of supply of adhesive tape in the web separating device.
Figure 9C:
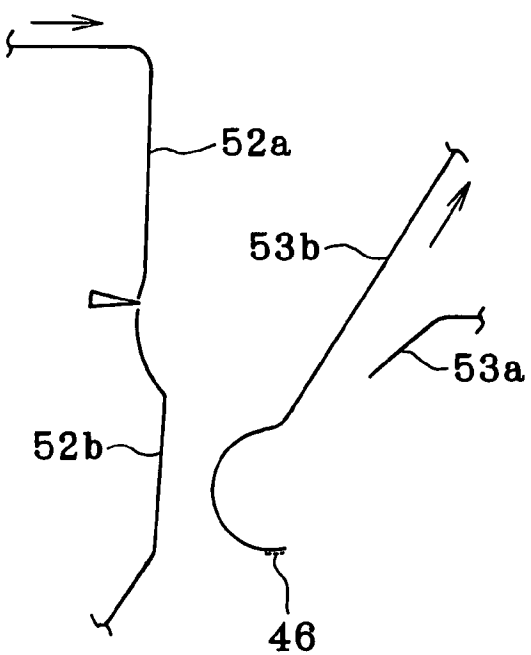

In FIGS. 7C and 9C, a rear end of the second downstream web section 53*b* is supplied with the double-sided adhesive tape 46 attached thereto by a transfer roller (not shown). The first web 52 is nipped between the cutting drum 10 and the cutting/joining drum 11, and cut into a first upstream web section 52*a* and a first downstream web section 52*b* . A rear end of the first upstream web section 52*a* is sucked by the suction mechanism 29. The first downstream web section 52*b* is nipped between the cutting/joining drum 11 and the first joining drum 12, and then wound by the winding device 4.

Figure 8B:
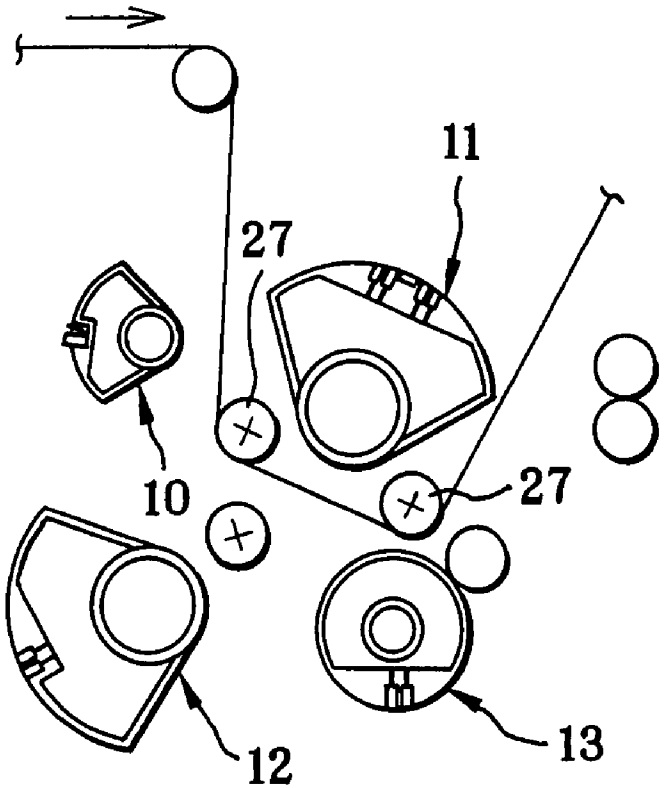
FIGS. 8B and 10B are explanatory views in elevation illustrating a finally joined state of the webs in the web separating device.
Figure 8A:
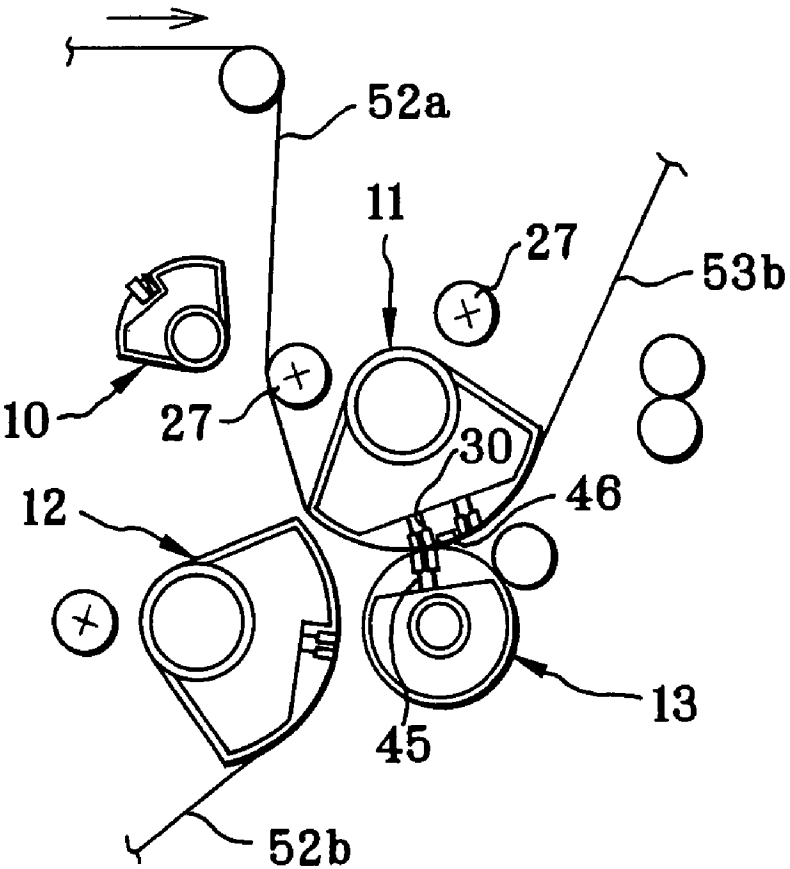
FIGS. 8A and 10A are explanatory views in elevation illustrating a state of attachment of the webs in the web separating device.
Figure 10B:
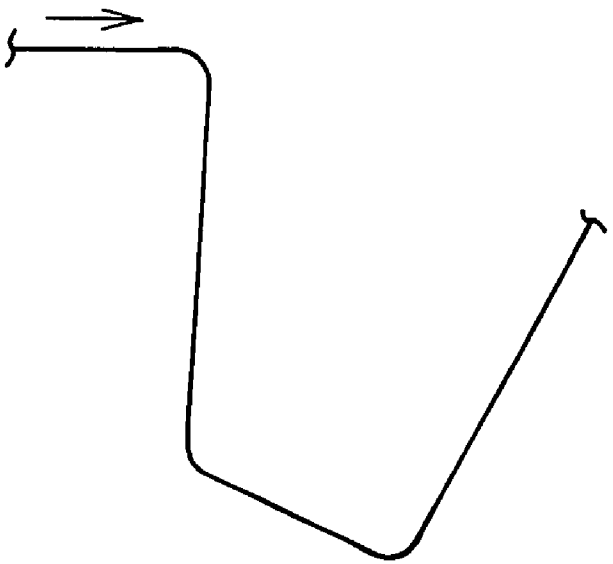
Figure 10A:
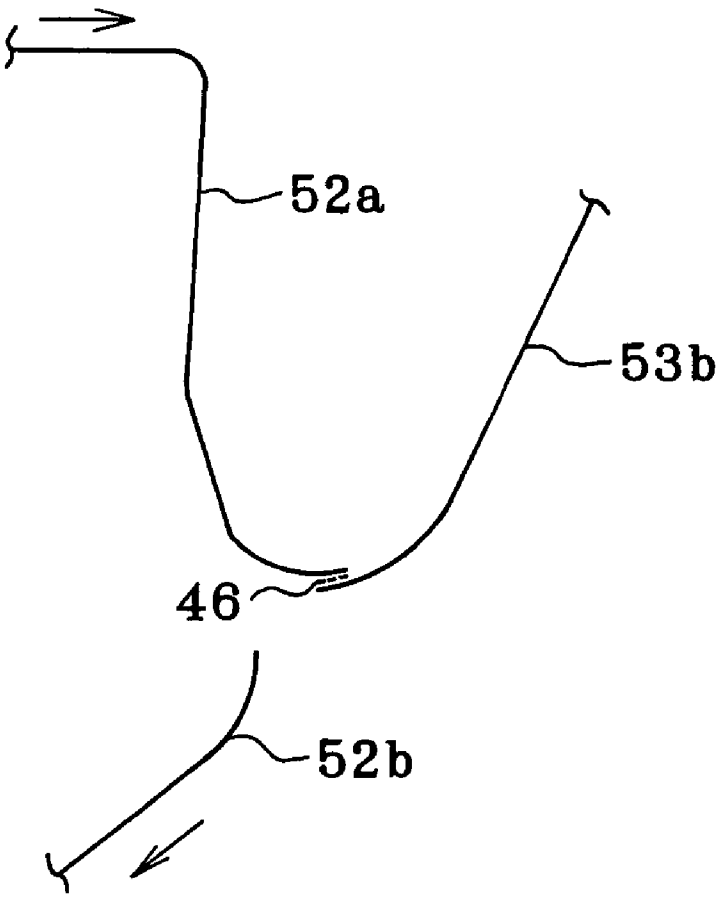

In FIGS. 8A and 10A, the front end of the first upstream web section 52*a* becomes overlapped on the rear end of the second downstream web section 53*b*, and becomes nipped between the cutting/joining drum 11 and the second joining drum 13. At the same time, the front end of the first upstream web section 52*a* and the rear end of the second downstream web section 53*b* are attached to one another by the double-sided adhesive tape 46. So the second downstream web section 53*b* becomes spliced with the first upstream web section 52*a*. Upon a stop of suction of the suction mechanisms 30 and 45, the first upstream web section 52*a* and the second upstream web section 53*a* are released from the drums.

In FIGS. 8B and 10B, the web sections are connected with one another. Then the operation is changed over from the disconnected mode to the continuous mode of the processes in the producing line. Rotation of the cutting drum 10, the cutting/joining drum 11, and the first and second joining drums 12 and 13 is stopped.

Figure 11:
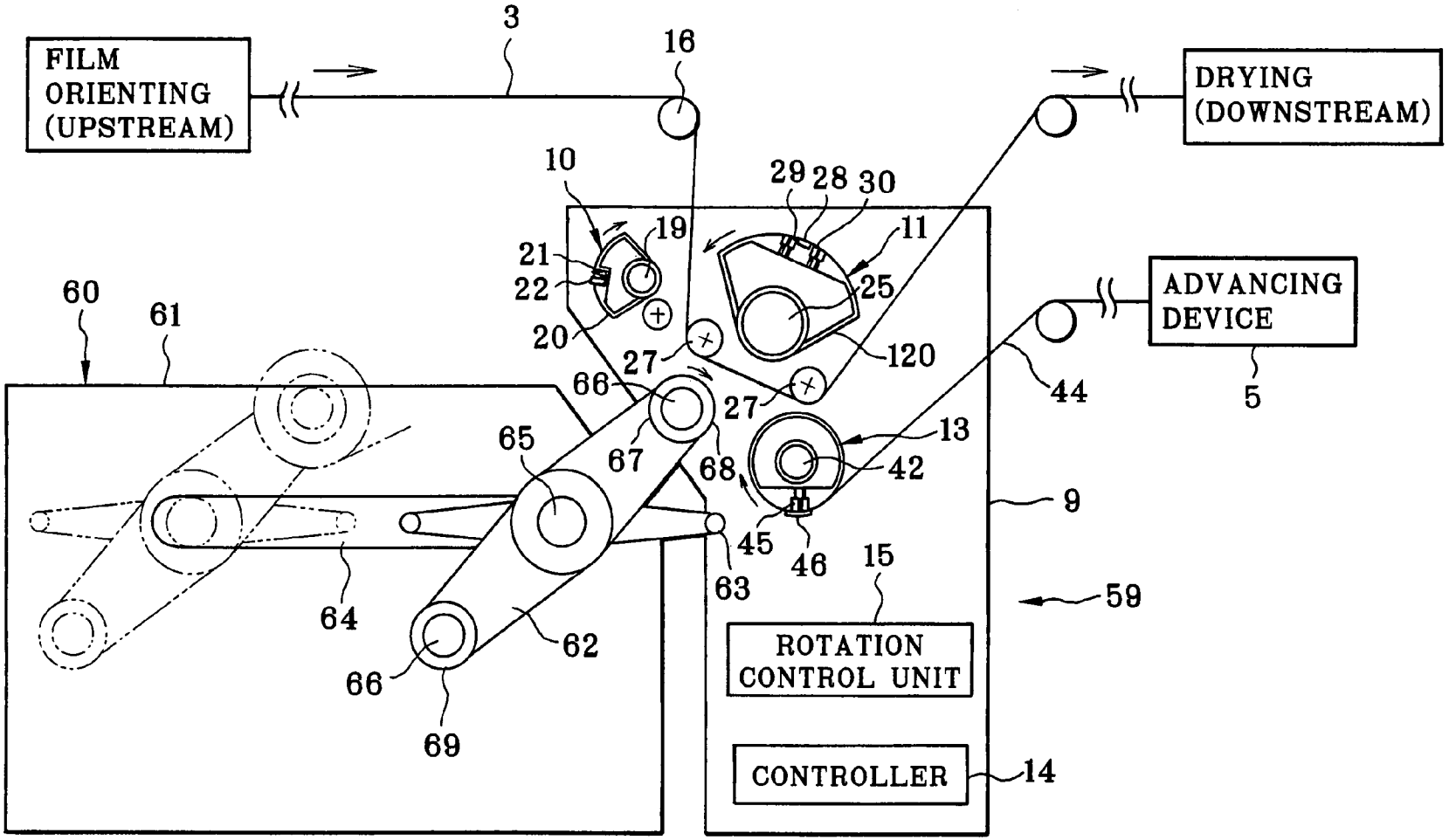
FIG. 11 is a front elevation with a block diagram, illustrating one preferred web separating device with a turret winder.

A second preferred embodiment is described. In FIG. 11, a web separating device 59 includes a turret winder 60. The turret winder 60 is an element used in place of the first joining drum 12 and the winding device 4 according to the first embodiment. Elements similar to the above embodiment are designated with identical reference numerals. The turret winder 60 is constituted by a frame 61, a spindle holder arm 62 or turret arm, and a guide roller 63. An arm shifting groove 64 is formed in the frame 61 to extend horizontally. An arm rotating pivot 65 keeps the spindle holder arm 62 rotatable thereabout. Also, the arm rotating pivot 65 is axially received in the arm shifting groove 64, to keep the spindle holder arm 62 movable in a horizontal direction. A drive shaft 66 is disposed at each of wing ends of the spindle holder arm 62. The rotation control unit 15 is controlled by the controller 14, and causes the drive shaft 66 to rotate. A spindle 67 is set at the drive shaft 66. A spindle peripheral surface 68 of the spindle 67 is provided with a suction mechanism (not shown).

During the separating operation, the spindle holder arm 62 is shifted nearer to the frame 9 horizontally. Also, the spindle 67 is shifted to the takeup position. The takeup position corresponds to a position of installing the first joining drum 12 in the above embodiment, and is indicated by solid lines in FIG. 11. The spindle 67 rotates in such a position that its spindle peripheral surface contacts the drum peripheral surface 35 of the cutting/joining drum 11. According to the processes in this sequence, the front end of the upstream web section 3*a* is sucked to the spindle 67, to wind the upstream web section 3*a* about the spindle 67. Then the spindle holder arm 62 is shifted away from the frame 9. Also, the spindle 67 shifts to a web winding position. The web winding position is indicated by the phantom lines in FIG. 11. The upstream web section 3*a* is wound by the spindle 67 without interference of those drums. When a portion of the upstream web section 3*a* at a predetermined amount is wound by the spindle 67, the spindle holder arm 62 is caused to make a half rotation. So a second spindle 69 is prepared, and can be used to wind the upstream web section 3*a* in a rewinding manner. Note that a combining operation is made while the spindle 67 is set in the web winding position.

A third preferred embodiment is hereinafter described, which is in consideration of occurrence of failure in the downstream positioned apparatus for the drying process. Only the downstream web section is transported in the downstream direction only at the separating operation.

Figure 12:
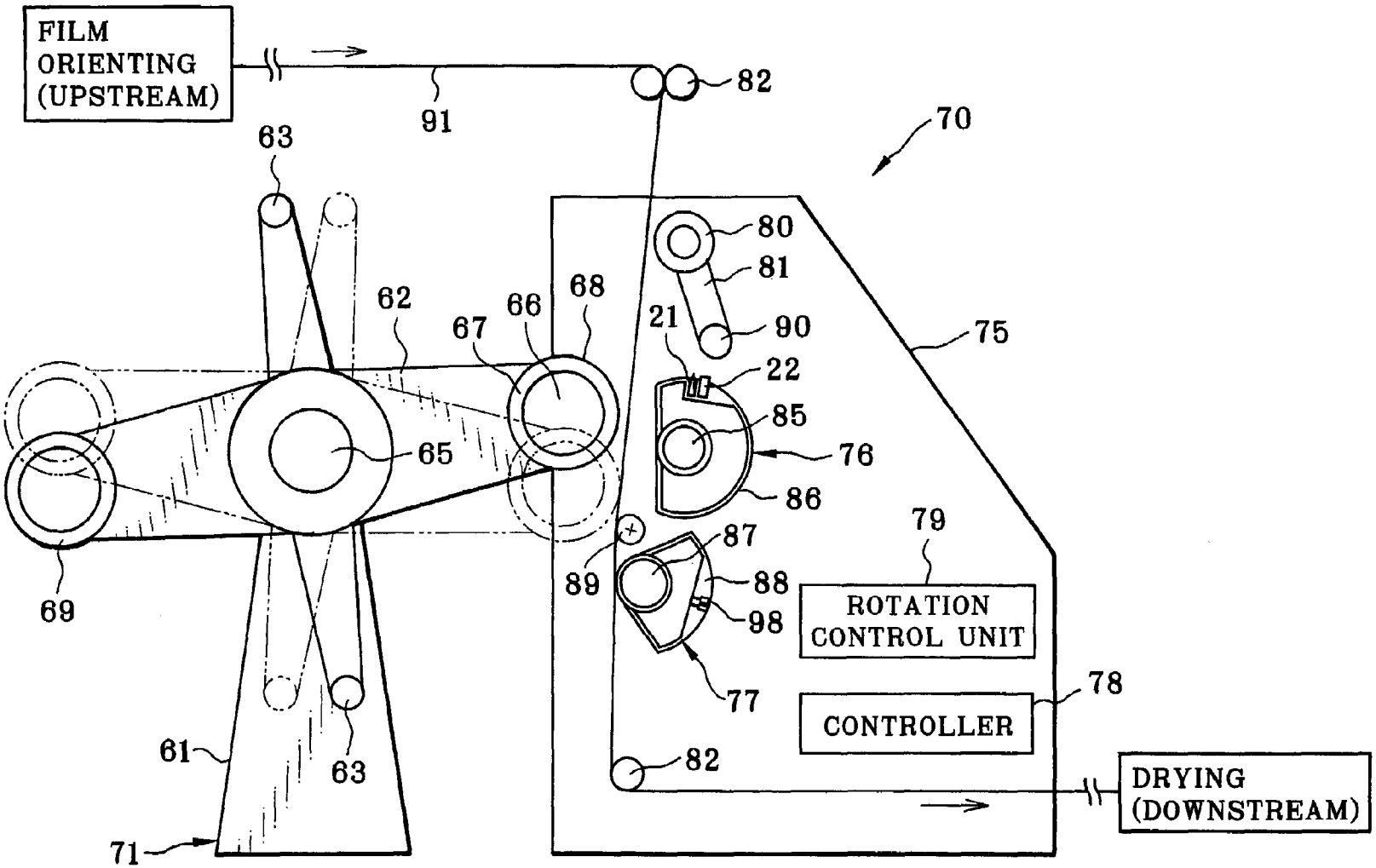
FIG. 12 is a front elevation with a block diagram, illustrating another preferred web separating device with a turret winder.

In FIG. 12, a web separating device 70 has a turret winder 71. The turret winder 71 has the basically same structure as the turret winder 60. A difference of the turret winder 71 from the turret winder 60 lies in that the spindle holder arm 62 is rotatable but not movable linearly.

For the separating process, the spindle holder arm 62 shifts to the position indicated by the solid lines in FIG. 12, to set the spindle 67 in the takeup position. For the connecting process, the spindle holder arm 62 shifts to the position indicated in phantom lines of FIG. 12, to set the spindle 67 in the connecting position.

Elements of the web separating device 70 include a frame 75, a cutting drum 76, a joining drum 77, a controller 78, a rotation control unit 79, a nip roller 80, a nip roller support arm 81, and plural pass rolls 82. The spindle 67 is positioned on one side with respect to the path of the web, and has the structure described above.

The cutting drum 76 is rotatable about a shaft 85 on a second side with respect to the web path. A drum peripheral surface 86 of the cutting drum 76 is positioned to contact the spindle peripheral surface 68 of the spindle 67 set in the takeup position. One gap portion is formed in the drum peripheral surface 86 of the cutting drum 76, to enable the web in a non-contact manner from the cutting drum 76. The cutter 21 and the biasing sponge rubber 22 are disposed in the drum peripheral surface 86 of the cutting drum 76 in a manner similar to the first embodiment.

The joining drum 77 is rotatable about a shaft 87, and positioned downstream from the cutting drum 76. The joining drum 77 is on the same side as the cutting drum 76 with respect to the web path. A drum peripheral surface 88 of the joining drum 77 is positioned to contact the spindle peripheral surface 68 of the spindle 67. A gap portion is formed to retreat from the spindle peripheral surface 68 in the joining drum 77, and has a sector shape. A single guide roller 89 as a path forming guide is disposed in the gap portion or space, is supported on the joining drum 77, and causes the web to pass in a non-contact manner.

The nip roller support arm 81 is positioned upstream from the cutting drum 76 and on the same side as viewed along the web path. The nip roller 80 is disposed at one end of the nip roller support arm 81. The nip roller support arm 81 rotates about a pivot 90, so that the nip roller 80 is pressed against the spindle 67 set in the takeup position.

There is a suction mechanism 98 on the drum peripheral surface 88 of the joining drum 77 in the same structure as that of the first embodiment. A second web 95, to be described later, has a rear end, which is retained on the suction mechanism 98 by suction. A double-sided adhesive tape 99 is attached to a surface of the second web 95 back to the surface retained by the suction. See FIG. 15A.

The rotation control unit 79 is caused by the controller 78 to control rotations of the drums, the spindle 67, the nip roller 80, the nip roller support arm 81 and the like in a manner similar to the first embodiment.

Figure 13A:
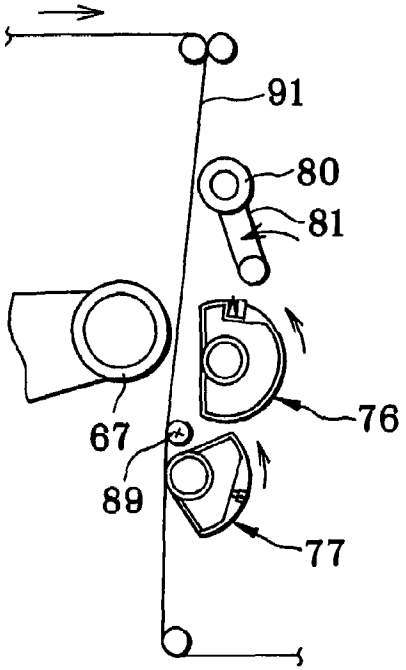
FIGS. 13A and 14A are explanatory views in elevation illustrating an initial state of the web separating device in a separating sequence.

The operation is described with FIGS. 13A-14D. In FIGS. 13A and 14A, a web 91 is transported to the web separating device 70. In case of a normal operation of the downstream positioned apparatuses without failure, the web 91 is simply transported.

If there occurs a problem in the downstream positioned apparatuses, the controller 78 immediately generates a separating command signal. In response to this, the cutting drum 76, the joining drum 77 and the spindle 67 start rotation. The nip roller support arm 81 shifts to a position for pressing the nip roller 80 on the spindle 67. The nip roller 80 is rotated at such a rate that its peripheral speed is equal to a transporting speed of the web 91. Note that the joining drum 77 may not be rotated in the separating process.

Figure 13B:
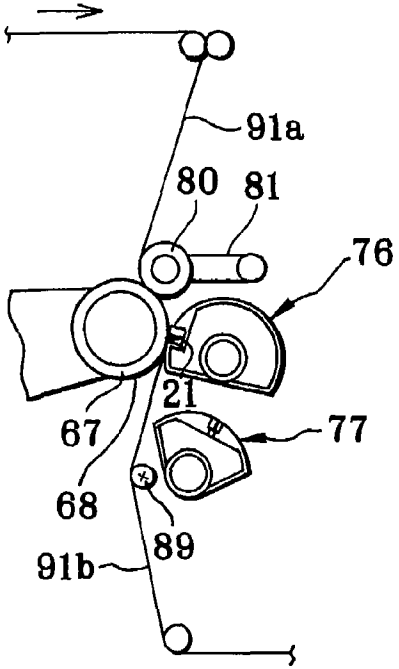
FIGS. 13B and 14B are explanatory views in elevation illustrating a state of cutting the web in the web separating device.
Figure 13C:
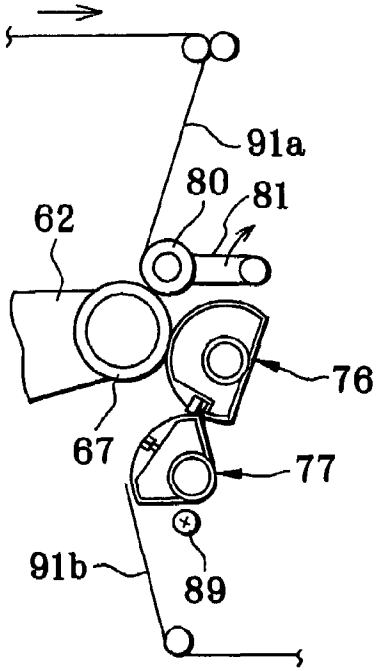
FIGS. 13C and 14C are explanatory views in elevation illustrating a state of winding of an upstream web section in the web separating device.
Figure 13D:
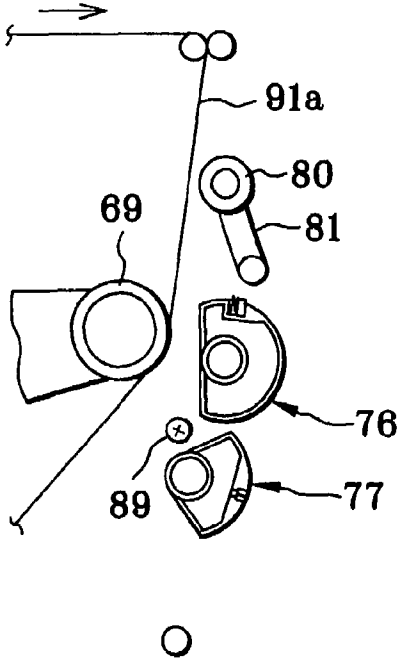
FIGS. 13D and 14D are explanatory views in elevation illustrating a state of setting an unloaded spindle in the web separating device.
Figure 14A:
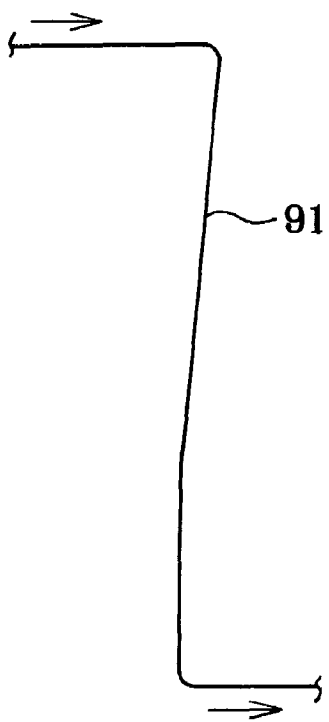
Figure 14B:
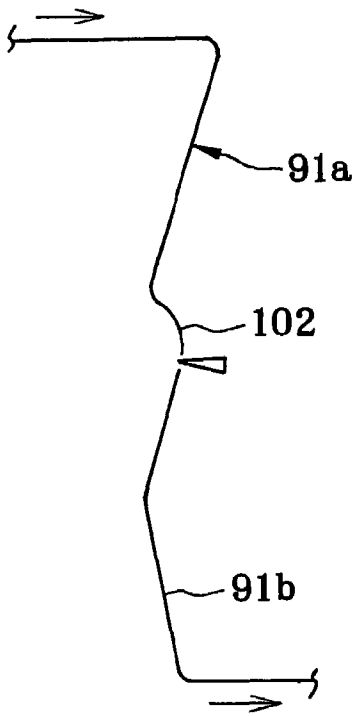
Figure 14C:
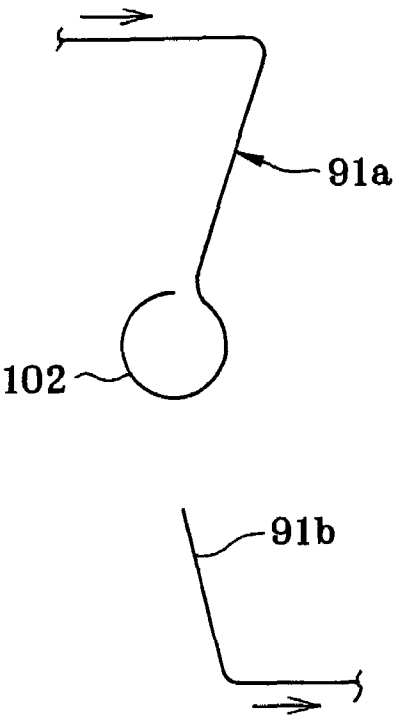
Figure 14D:
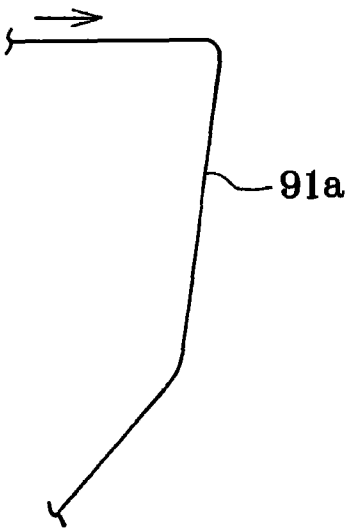

Rotations being made by the plural drums, the web 91 is cut when squeezed between the cutter 21 of the cutting drum 76 and the spindle peripheral surface 68 of the spindle 67, as depicted in FIGS. 13B and 14B. The web 91 is cut into an upstream web section 91*a* and a downstream web section 91*b*. A front end of the upstream web section 91*a* is sucked by a suction mechanism (not shown) in the spindle 67. The spindle 67 rotates to wind the upstream web section 91*a* thereabout. At the same time, the downstream web section 91*b* is fed in the downstream direction. See FIGS. 13C and 14C. The nip roller support arm 81 moves in a direction to shift the nip roller 80 away from the spindle 67. Also, the spindle holder arm 62 makes half a rotation.

Then the second spindle 69 in an unloaded state is shifted to the takeup position. See FIGS. 13D and 14D. A web roll, which is constituted by the upstream web section 91*a* wound about the spindle 67, increases its diameter until the diameter comes up to a predetermined value. At this time, it is possible to redirect the upstream web section 91*a* to the second spindle 69 by separation from the spindle 67. Note that the web roll with at least the predetermined diameter can be removed from the drive shaft 66. Another spindle in an unloaded state can be set instead on the drive shaft 66. Then the cutting drum 76, the joining drum 77 and the nip roller 80 are stopped from rotating.

FIGS. 15A-16D are referred to for the connecting operation. Note that a term of a first web 94 is used for that transported in the upstream positioned apparatuses and wound about the spindle 67, and the term of the second web 95 is used for that in connection to the downstream positioned apparatuses.

Figure 15A:
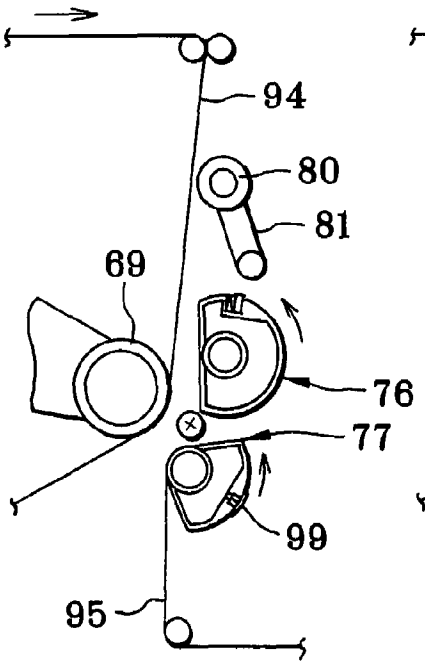
FIGS. 15A and 16A are explanatory views in elevation illustrating an initial state of the web separating device in a combining sequence.
Figure 16A:
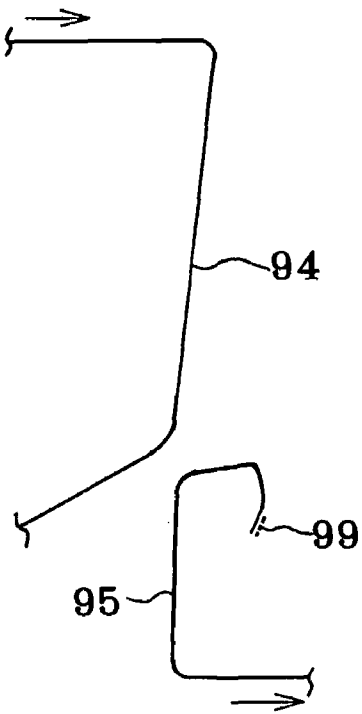

When the problem in the downstream positioned apparatus is solved, then the controller 78 generates a connecting command signal. As illustrated in FIGS. 15A and 16A, the cutting drum 76 and the joining drum 77 start rotating in response to the signal from the controller 78. The first web 94 is being wound about the spindle 67 which is set at a drive shaft located away from the frame 75. The second spindle 69 in the connecting position in the unloaded state continues rotation, and guides the first web 94 as a web guide. In the connecting process, the nip roller 80 and the nip roller support arm 81 do not move in a manner of the separating process.

Figure 15B:
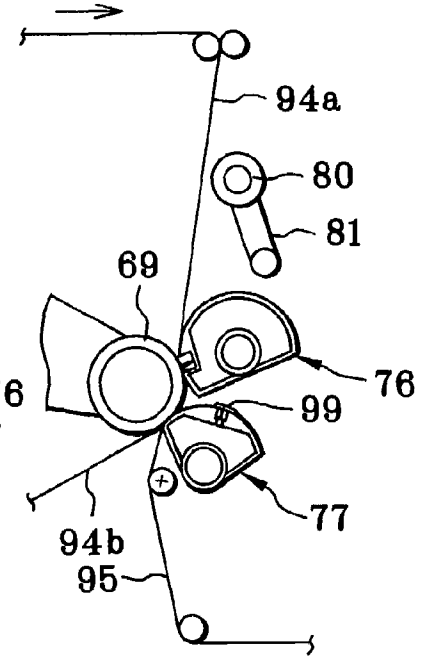
FIGS. 15B and 16B are explanatory views in elevation illustrating a state of attachment of the webs in the web separating device.
Figure 15C:
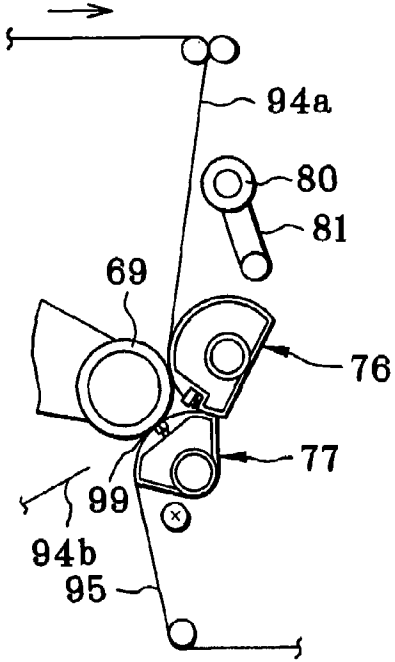
FIGS. 15C and 16C are explanatory views in elevation illustrating a state of removing the guide leader in the web separating device.
Figure 16B:
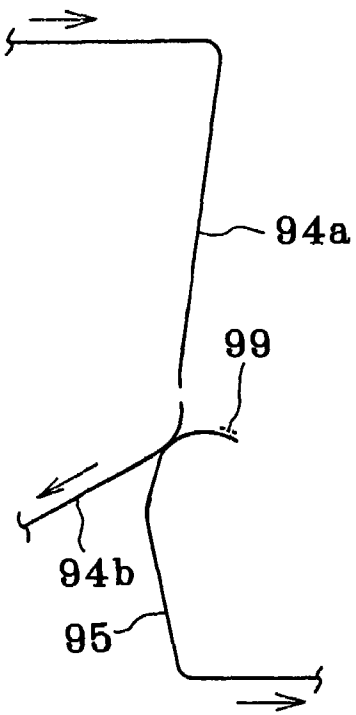
Figure 16C:
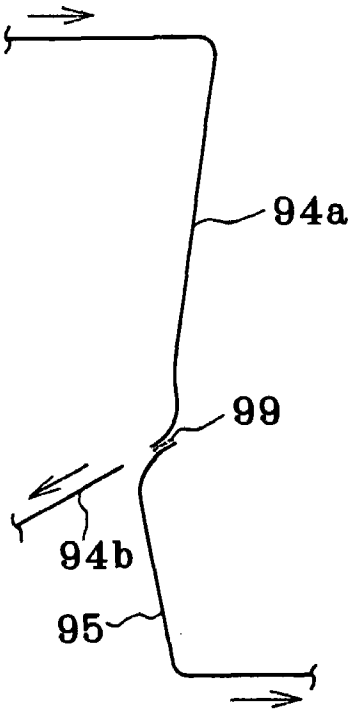

In FIGS. 15B and 16B, rotations are being made by the drums. The first web 94 is cut to obtain a first upstream web section 94*a* and a first downstream web section 94*b*. The front end of the first upstream web section 94*a* is retained on the second spindle 69 by suction. The first downstream web section 94*b* is wound by the spindle 67. A direction of feeding of the front end of the first upstream web section 94*a* immediately after cutting is controlled within an angular range of ±10 degrees with reference to the downward vertical direction. Therefore, a direction of feeding of a front end of the first upstream web section 94*a* coincides with a direction of receiving force under gravity at the front end. It is possible to keep the front end of the first upstream web section 94*a* stable without fluctuation.

In the course of the various drums, the front end of the first upstream web section 94*a* is overlapped on the front end of the second web 95, and nipped. See FIGS. 15C and 16C. The double-sided adhesive tape 99 can be used to attach the second web 95 with the first upstream web section 94*a*.

Figure 15D:
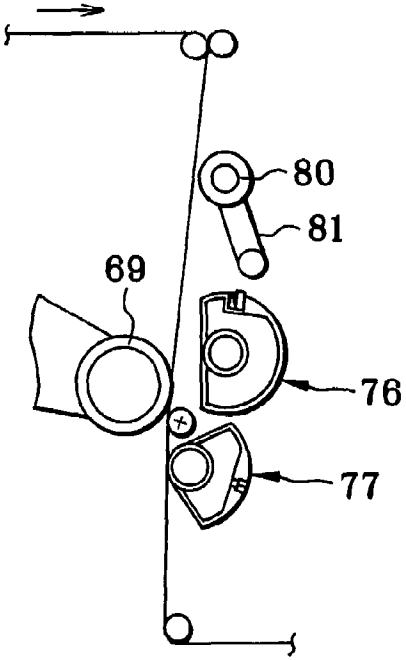
FIGS. 15D and 16D are explanatory views in elevation illustrating a finally joined state of the webs in the web separating device.
Figure 16D:
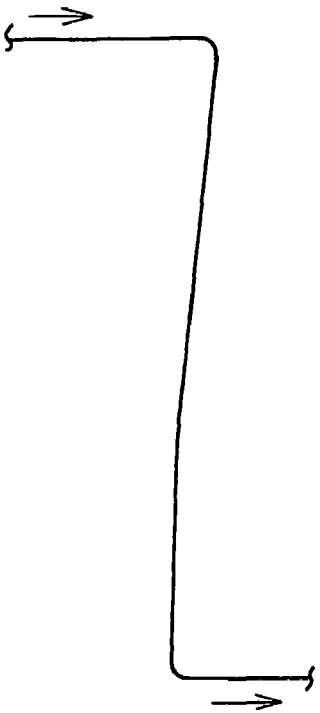

The first upstream web section 94*a* and the second web 95, when released from nipping of the plural drums, are connected with one another as illustrated in FIGS. 15D and 16D. The connected web is transported in the downstream direction. After this, the drums and the spindle stop rotation.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. web separating device for separating a continuously transported web into upstream and downstream web sections, wherein a guide leader is connected therewith after separation, said web separating device comprising:

a cutting drum, disposed on a first side with respect to a web path of said web, and having a cutter for cutting said web in a width direction thereof;

a cutting/joining drum, disposed on a second side with respect to said web path, for contacting said cutting drum with a peripheral surface thereof at a time of cutting;

a first joining drum disposed on said first side with respect to said web path and downstream from said cutting drum, having said guide leader retained thereon, for contacting said cutting/joining drum with a peripheral surface thereof, and for attaching a rear end of said guide leader to a front end of said upstream web section after cutting with said cutting drum;

a path forming unit, disposed between said cutting drum and said cutting/joining drum, and between said cutting/joining drum and said first joining drum, for allowing passage of said web from said cutting drum, said cutting/joining drum, and said first joining drum before and after being cut or attached; and a rotation control unit which controls rotation of said cutting drum, said cutting/joining drum, and said first joining drum in synchronism;

wherein said front end of said upstream web section upon being cut is directed within an angular range of +10 degrees with reference to a vertically downward direction.

2. A web separating device as defined in claim 1, further comprising:

a second joining drum, disposed downstream from said first joining drum, positioned on said first side with respect to said web path, for contacting said cutting/joining drum with a peripheral surface thereof, and for attaching a second guide leader to a rear end of said downstream web section, said second guide leader being different from said guide leader;

a second path forming unit, disposed between said cutting/joining drum and said second joining drum, for passage of said web;

wherein said rotation control unit further keeps said second joining drum and said cutting/joining drum in synchronism.

3. A web separating device as defined in claim 1, wherein at least one of said cutting/joining drum and said first joining drum further comprises a drum core having a first portion for constituting a drum peripheral surface partially, and a second portion having a smaller diameter than said drum peripheral surface;

said path forming unit includes a rotatable guide roller for guiding said web outside said second portion of said drum core.

4. A web separating device as defined in claim 3, wherein said at least one of said cutting/joining drum and said first joining drum further comprises first and second end disks positioned at respectively ends of said drum core;

said guide roller is between said first and second end disks, and is secured thereto in a rotatable manner.

5. A web separating device as defined in claim 1, wherein said cutter protrudes from a peripheral surface of said cutting drum;

said cutting/joining drum includes a receiving slot, formed in a peripheral surface thereof, for receiving entry of said cutter.

6. A web separating device as defined in claim 5, wherein said cutting/joining drum includes a suction unit for suction of said front end of said upstream web section close to an upstream edge of said receiving slot upstream with respect to a drum rotational direction.

7. A web separating device as defined in claim 5, wherein said cutting/joining drum includes a suction unit for suction of said rear end of said downstream web section close to a downstream edge of said receiving slot downstream with respect to a drum rotational direction.

8. A web separating device as defined in claim 1, wherein said cutting drum includes a biasing mechanism for biasing said front end of said upstream web section close to said cutter and upstream from said cutter according to a drum rotational direction.

9. A web separating device as defined in claim 8, wherein said biasing mechanism comprises a resilient member or an air blowing mechanism.

10. A web separating device as defined in claim 1, wherein the rotation control unit controls rotation of said cutting drum, said cutting/joining drum, and said first joining drum in synchronism throughout the process of separating the continuously transported web into upstream and downstream web sections.

11. A web separating device for separation of web transported continuously, comprising:

a cutting/joining drum, rotatable in contact with said web on a peripheral surface thereof a cutting drum, positioned opposite to said cutting/joining drum with respect to a web path of said web, for contacting said cutting/joining drum with a peripheral surface thereof, said cutting drum having a cutter for cutting said web in a width direction thereof in cooperation with said cutting/joining drum, to obtain upstream and downstream web sections;

a joining drum, positioned opposite to said cutting/joining drum with respect to said web path, for contacting said cutting/joining drum with a peripheral surface thereof, and for attaching a guide leader to a rear end of said downstream web section;

a rotation control unit for rotating said cutting/joining drum, said cutting drum, and said joining drum; and a path forming unit, disposed between said cutting/joining drum and said cutting drum, and between said cutting/joining drum and said joining drum, for allowing passage of said web and said upstream and downstream web sections before and after being cut or attached.

12. A web separating device for separation of web transported continuously, comprising:

a cutting/joining drum, rotatable in contact with said web on a peripheral surface thereof a cutting drum, positioned opposite to said cutting/joining drum with respect to a web path of said web, for contacting said cutting/joining drum with a peripheral surface thereof, said cutting drum having a cutter for cutting said web in a width direction thereof in cooperation with said cutting/joining drum, to obtain upstream and downstream web sections;

a spindle, positioned opposite to said cutting/joining drum with respect to said web path, for contacting said cutting/joining drum with a peripheral surface thereof, and for winding said upstream web section;

a rotation control unit for rotating said cutting/joining drum, said cutting drum, and said spindle;

a path forming unit, disposed between said cutting/joining drum and said cutting drum, and between said cutting/joining drum and said spindle, for allowing passage of said web and said upstream and downstream web sections before and after being cut; and a moving mechanism for moving said spindle between a takeup position and a web winding position, wherein said spindle, when in said takeup position, contacts said cutting/joining drum, for a front end takeup of said upstream web section, and when in said web winding position, moves away from said cutting/joining drum, and winds said upstream web section.

13. A web separating device as defined in claim 12, further comprising a joining drum, disposed downstream from said spindle, positioned opposite to said cutting/joining drum according to said web path of said web, for contacting said cutting/joining drum with a peripheral surface thereof, to attach a guide leader to a rear end of said downstream web section.

14. A web separating device as defined in claim 13, further comprising a spindle holder arm for supporting said spindle in a rotatable manner;

wherein said moving mechanism includes:

an arm shifting mechanism for shifting said spindle holder arm in one direction, to move said spindle to respectively said takeup position and said web winding position; and an arm rotating mechanism for rotating said spindle holder arm when said spindle is in said web winding position, to move said spindle further to an exchanging position adapted to exchange of said spindle.

15. A web separating device for separation of web transported continuously, comprising:

a cutting drum, having a cutter for cutting said web in a width direction thereof, to obtain upstream and downstream web sections;

a spindle, positioned opposite to said cutting drum with respect to a web path of said web, for contacting said cutting drum with a peripheral surface thereof, for winding said upstream web section;

a rotation control unit for rotating said cutting drum and said spindle;

a path forming unit, disposed between said cutting drum and said spindle, for allowing passage of said web and said upstream and downstream web sections before and after being cut; and a moving mechanism for moving said spindle between a takeup position and a web winding position, wherein said spindle, when in said takeup position, contacts said cutting drum, for cutting of said web with said cutter and for a front end takeup of said upstream web section, and when in said web winding position, moves away from said cutting drum, to wind said upstream web section.

16. A web separating device as defined in claim 15, wherein said moving mechanism moves said spindle further to a joining position which is downstream from said takeup position according to said web path, and where a peripheral surface of said spindle contact a peripheral surface of said cutting drum;

further comprising a joining drum, disposed downstream from said cutting drum according to said web path, for retaining a rear end of a guide leader and for contact said spindle in said joining position with a peripheral surface thereof, and for attaching a front end of said upstream web section to said guide leader after cutting of said web with said cutting drum.

17. A web separating device as defined in claim 16, further comprising a spindle holder arm for supporting said spindle in a rotatable manner;

wherein said moving mechanism includes an arm rotating mechanism for rotating said spindle holder arm, to move said spindle to respectively said takeup position and said web winding position.

* * * * *